US008777367B2

(12) United States Patent
Adachi

(10) Patent No.: US 8,777,367 B2
(45) Date of Patent: Jul. 15, 2014

(54) INKJET RECORDING DEVICE AND METHOD FOR CONTROLLING THE SAME

(71) Applicant: Canon Kabushiki Kaisha, Tokyo (JP)

(72) Inventor: Eiichi Adachi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/830,641

(22) Filed: Mar. 14, 2013

(65) Prior Publication Data

US 2013/0257979 A1 Oct. 3, 2013

(30) Foreign Application Priority Data

Mar. 29, 2012 (JP) ..... 2012-076641
Mar. 7, 2013 (JP) ..... 2013-045528

(51) Int. Cl.
*B41J 29/393* (2006.01)

(52) U.S. Cl.
USPC ..... 347/19; 347/33

(58) Field of Classification Search
USPC ..... 347/19, 20, 22, 33
See application file for complete search history.

(56) References Cited

U.S. PATENT DOCUMENTS

| | | | | |
|---|---|---|---|---|
| 6,588,873 | B1 * | 7/2003 | Walsh et al. | 347/23 |
| 6,834,930 | B2 * | 12/2004 | Steinfield et al. | 347/33 |
| 2006/0066664 | A1 | 3/2006 | Kachi | |
| 2008/0316253 | A1 | 12/2008 | Inuoe | |
| 2010/0245466 | A1 | 9/2010 | Inoue | |

FOREIGN PATENT DOCUMENTS

| | | | |
|---|---|---|---|
| JP | 10-157090 | A | 6/1998 |
| JP | 2962964 | B2 | 10/1999 |
| JP | 2003-300329 | A | 10/2003 |

* cited by examiner

*Primary Examiner* — Lamson Nguyen
(74) *Attorney, Agent, or Firm* — Canon USA, Inc., IP Division

(57) ABSTRACT

An inkjet recording apparatus includes a recording head which includes an ejection surface having a plurality of ejection ports which eject ink, a wiping unit which includes a wiping member which wipes the ejection surface and a reeling unit which reels the wiping member, a remaining amount obtaining unit which obtains a remaining amount of the wiping member, and a use amount estimation unit which estimates a use amount of the wiping member in accordance with recording data. The inkjet recording apparatus controls a wiping operation performed by the wiping unit in accordance with the remaining amount and the estimated use amount.

14 Claims, 6 Drawing Sheets

INKJET RECORDING DEVICE AND METHOD FOR CONTROLLING THE SAME

BACKGROUND OF THE INVENTION

1. Field of the Invention

The present invention relates to an inkjet recording device and a method for controlling the inkjet recording device.

2. Description of the Related Art

In inkjet recording apparatuses, ink which adheres to a face surface (a surface of an ejection port) of a recording head including the ejection port (a nozzle) which ejects ink disturbs normal ink ejection in some cases. In particular, when a plurality of inks which mutually have reactive properties are used, when an image is formed using reaction liquid and ink, or when ink is solidified by ultraviolet rays, micro waves, or heat so that toughness is improved, removal of ink which adheres to the face surface is difficult. In order to address a state in which defect of ejection may be invited due to ink which adheres to a face surface, general inkjet recording apparatuses include a wiping member which wipes ink which adheres to a face surface. In general, a wiper made of rubber is used as the wiping member. The wiper performs an operation of wiping a face surface so as to sweep ink away (wiping) (refer to Japanese Patent Laid-Open No. 10-157090). As an example, a wiper is disposed on a movement track of a face surface of a recording head, and the face surface is wiped by the wiper when the recording head moves from a recording region to a waiting position. When the wiping operation is not to be performed, the wiper moves to a retracting position so as not to make contact with the face surface. With this configuration, the face surface may be wiped without deteriorating throughput of a recording operation.

However, in some types of ink, it is difficult to wipe a face surface only by the wiping operation since liquid components of ink which adheres to the face surface evaporates before the wiping operation is performed. Specifically, high wiping performance such as strong wiping on a face surface is requested depending on types of ink when compared with a case where normal ink is used.

When residues of solidified ink tend to remain on the face surface even after the wiping operation, an absorbent wiping member of a sheet shape may be used. An inkjet recording apparatus including a mechanism of wiping a face surface by making such a sheet wiping member come contact with the face surface has been proposed in Japanese Patent Laid-Open No. 2003-300329. Furthermore, an inkjet recording apparatus in which cleaning liquid is supplied to a wiper so that improved wiping performance is attained has been proposed in Japanese Patent No. 2962964.

As disclosed in Japanese Patent Laid-Open No. 2003-300329, in the wiping mechanism including the absorbent wiping member of a sheet shape, in general, the wiping member is accommodated in a body of the recording apparatus in a rolled state, and the wiping member is successively reeled out so as to be used for an operation of wiping the face surface. A portion which has been used by the wiping operation and has absorbed ink is moved from a position to be contact with the face surface and an unused portion is newly supplied to the position to be contact with the face surface so as to stand by for the next wiping operation. Thereafter, when the entire accommodated wiping member is reeled out and used, the used wiping member is detached and a new wiping member is attached to the body of the recording apparatus instead. In this configuration, when an unused portion of the wiping member accommodated in the recording apparatus becomes small, the following problems arise.

First, in a case where a wiping operation is performed during a recording operation, a wiping member may run out during the recording operation after a printing job is newly started. In general, in a recording operation, image data to be recorded is converted into recording data and the recording data is supplied from a printer driver of a host computer to an inkjet recording apparatus. Then the inkjet recording apparatus performs a recording operation while colors to be ejected, nozzles, and the number of paths are controlled in accordance with the received recording data. However, in particular, a large inkjet recording apparatus deals with a large amount of data representing an image to be formed in many cases, and therefore, a long period of time is used by such an inkjet recording apparatus to receive entire recording data depending on capability of the host computer or communication environment. If recording is to be started after the entire recording data is received, the inkjet recording apparatus enters a waiting state until the reception is completed, and therefore, throughput is lowered. Therefore, such a large inkjet recording apparatus starts recording when receiving a predetermined amount of recording data instead of the entire recording data, and thereafter, the large inkjet recording apparatus performs an operation of receiving the recording data and a recording operation in parallel in many cases. In this case, there arises the problem in that a wiping member runs out during the recording operation as described above. Specifically, since the recording operation is started before the entire recording data is received, the total number of times the wiping operation is performed during the recording operation is not obtained when the recording operation is started. Therefore, an amount of use of the wiping member in the recording operation has not been determined, and if a remaining amount of an unused portion of the wiping member is small, the wiping member may run out during the recording operation. If the wiping member runs out, the recording operation is not continued, and therefore, the recording operation is temporarily stopped when the remaining amount of the unused portion of the wiping member becomes small and the user is prompted to replace the wiping member. However, if the recording operation is interrupted in the inkjet recording apparatus, different colors may be obtained in an image before and after the interruption of the recording operation and quality of the image may be deteriorated.

Second, an amount of a waste unused portion of the wiping member may be increased. In a case where the total number of times the wiping operation is performed during the recording operation is calculated in advance, an amount of an unused portion of the wiping member accommodated in the inkjet recording apparatus may not be enough for an amount of the wiping member to be used. In this case, in order to prevent the wiping member from running out during the recording operation, the wiping member is replaced by a new one before the recording operation is started even when an unused portion remains. Therefore, the wiping member including the unused portion is discarded. In particular, when large image data is to be recorded, and therefore, a large amount of a wiping member is used by one recording operation, even when an unused portion of the wiping member is comparatively large, the wiping member is replaced by a new one if the unused portion of the wiping member is slightly short of an amount of the wiping member to be used for one recording operation. Therefore, a large amount of an unused portion of the wiping member is discarded, resulting in large waste of cost and sources. This problem may arise when a recording operation is started after entire recording data is received so that an amount of the wiping member to be used is determined while deterioration of throughput is accepted.

SUMMARY OF THE INVENTION

Accordingly, the present invention provides an inkjet recording apparatus and an inkjet recording method which are capable of performing an operation of appropriately recovering an ejection surface while a wiping member does not run out during a recording operation.

According to an embodiment of the present invention, there is provided an inkjet recording apparatus including a recording head configured to include an ejection surface having a plurality of ejection ports which eject ink, a carriage configured to include the recording head and perform reciprocation scanning, a wiping unit configured to include a wiping member which wipes the ejection surface and a reeling unit which reel the wiping member, an obtaining unit configured to obtain a remaining amount of the wiping member, an estimation unit configured to estimate a use amount of the wiping member in accordance with recording data, and a controller configured to control the wiping unit in accordance with the remaining amount and the use amount.

Accordingly, an appropriate recovery operation may be performed while a wiping member does not run out during a recording operation.

Further features of the present invention will become apparent from the following description of exemplary embodiments with reference to the attached drawings.

DESCRIPTION OF THE EMBODIMENTS

Hereinafter, an embodiment of the present invention will be described with reference to the accompanying drawings.

Figure 1:
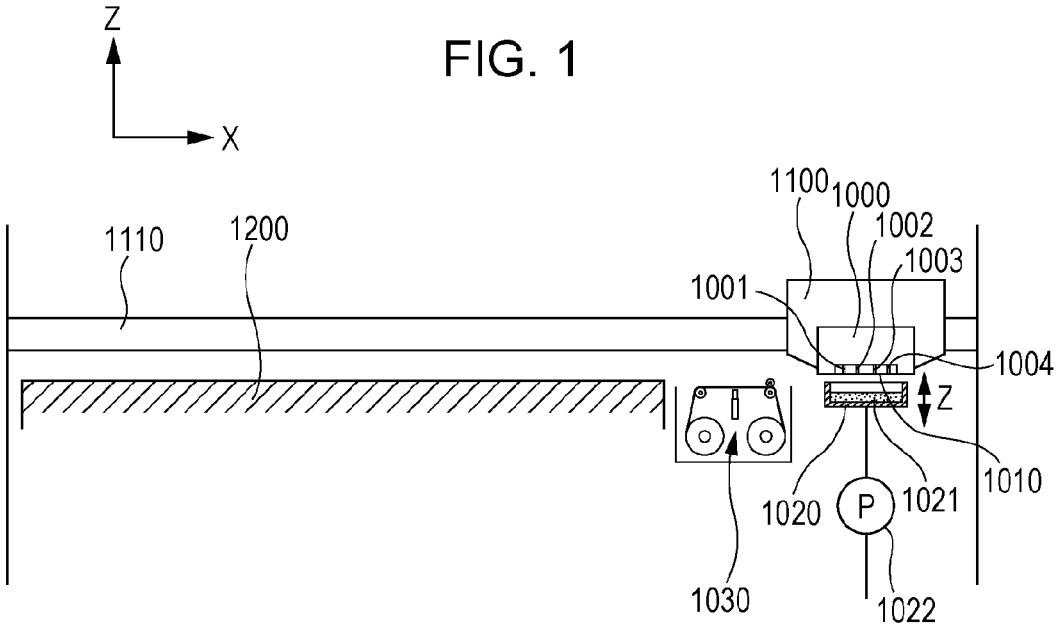
FIG. 1 is a plan view schematically illustrating a main section of an inkjet recording apparatus according to an embodiment of the present invention.

FIG. 1 is a plan view schematically illustrating a main section of an inkjet recording apparatus according to an embodiment of the present invention. A configuration of the inkjet recording apparatus will be described. A plurality of ejection ports 1001 to 1004 which individually eject inks of various colors such as yellow, magenta, cyan, and black are disposed on an ink ejection surface (face surface) 1010 of a recording head 1000. The inks of yellow, magenta, cyan, and black are supplied to the corresponding ejection ports 1001 to 1004 from ink tanks, not illustrated. The ejection ports 1001 to 1004 include respective electro-thermal transducers therein. When receiving electric signals in accordance with driving signals, the electro-thermal transducers heat, generate bubbles in the inks, and eject the inks from the ejection ports 1001 to 1004 by pressure of the bubbles.

The recording head 1000 is disposed on a carriage 1100 which is driven in a rotation manner by a carriage motor, not illustrated, so as to intermittently perform reciprocation scanning in a main scanning direction (X direction) while being guided by a guide shaft 1110. A platen 1200 which supports a recording-target medium (printing sheet) is disposed in a position facing a movement track of the carriage 1100 in a recording region of the recording head 1000.

A capping mechanism including a cap 1020 which performs capping on the ejection ports 1001 to 1004 is disposed in a waiting position which faces the movement track of the carriage 1100 and which is located outside the recording region (a side of the platen 1200). The cap 1020 performs reciprocation movement in a Z direction between a capping position and a separation position by means of a general method. The cap 1020 is connected to a pump 1022 and includes an ink absorber 1021. In the capping position, the cap 1020 may suppress evaporation of liquid components (solvents) included in the inks from the ejection ports 1001 to 1004 by covering the ink ejection surface 1010 which includes the ejection ports 1001 to 1004 disposed thereon and which is disposed on the recording head 1000. Furthermore, the capping mechanism performs a suction recovery operation of forcibly sucking the inks from the ejection ports 1001 to 1004 by operating the pump 1022 in a state in which the cap 1020 performs capping on the ink ejection surface 1010 of the recording head 1000.

Figure 2:
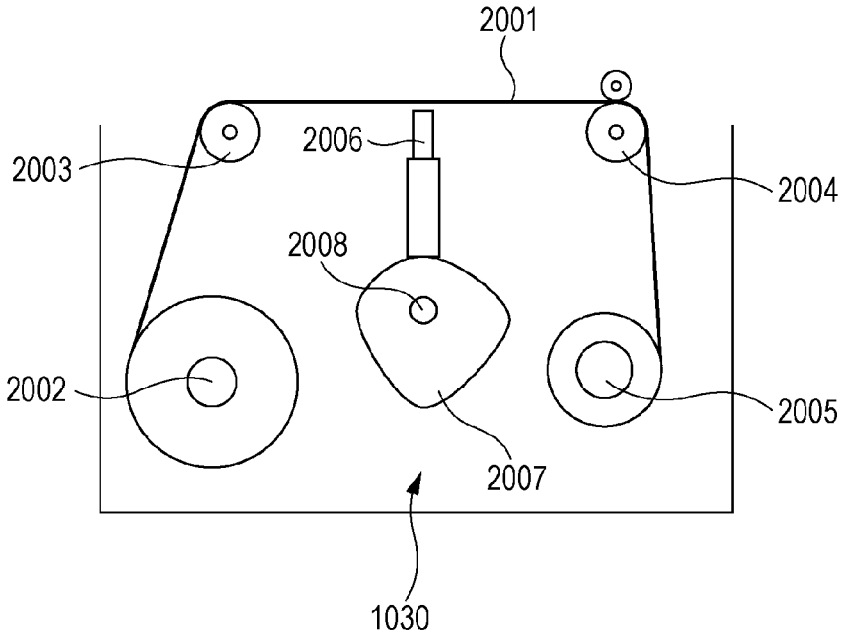
FIG. 2 is a diagram illustrating a wiping unit included in the inkjet recording apparatus of FIG. 1 in an enlarged manner.

A wiping unit 1030 (refer to FIG. 2) which wipes the face surface 1010 is disposed in a position between the platen 1200 and the cap 1020 which opposes the movement track of the face surface 1010 at a time of scanning performed by the carriage 1100. The wiping unit 1030 includes a wiping member 2001, a supply roller 2002, a guide roller 2003, a conveying roller pair 2004, a reeling roller 2005, a pressure member 2006, a lifting cam 2007, and a lifting-cam rotation shaft 2008.

The wiping member 2001 of a sheet shape is wound on the supply roller 2002 in a roll shape, and one end of the wiping member 2001 is drawn from the supply roller 2002 and fixed to the reeling roller 2005. The wiping member 2001 may be made of porous urethane foam, melamine foam, or non-woven fabric using polyolefin, PET, or nylon. In this embodiment, the wiping member 2001 has absorbency and is impregnated with wiping liquid in advance. As the wiping liquid, liquid which improves performance of wiping of inks which adhere to the face surface 1010 is preferably used, and specifically, liquid including water, a surface acting agent, and a solvent may be used.

By performing wiping using such a wiping member, even when ink including a solvent which is easily volatilized and which has a low boiling point, ink which includes a large amount of polymer so that pigments are dispersed, or ink which causes aggregation due to small dispersibility of pigments, which is difficult to be removed by normal wipers, is used, the face surface 1010 may be maintained in a preferable state. Note that examples of the solvent which is easily volatilized and which has a low boiling point include low molecular alcohol such as IPA (isopropyl alcohol), ketones such as MEK (methyl ethyl ketone), and esters such as ethyl acetate.

Furthermore, it is apparent that inks having functionality attained by phase transition caused by evaporation or heat or attained by change caused by evaporation such as dispersion breaking and solidification caused by increase of density due to evaporation of liquid components are more difficult to be removed when compared with the inks described above. However, when such a wiping member is used, such inks may be removed and the preferable state of the face surface 1010 may be maintained.

The wiping member 2001 is suspended between the supply roller 2002 and the reeling roller 2005 and is guided by the guide roller 2003 and the conveying roller pair 2004 between the supply roller 2002 and the reeling roller 2005. The wiping member 2001 is conveyed along the main scanning direction of the carriage 1100 by rotation of the conveying roller pair 2004 included in a wiping unit conveying mechanism, successively passes positions which face the movement track of the face surface 1010, and is reeled by the reeling roller 2005. Furthermore, the wiping member 2001 which is once reeled may be reeled back to the supply roller 2002 by reverse rotation of the conveying roller pair 2004. The pressure member 2006 which is made of a rubber elastic body is disposed so as to face a portion of the wiping member 2001 which extends in a straight line by being guided by the guide roller 2003 and the conveying roller pair 2004. The pressure member 2006 abuts on the lifting cam 2007 which is rotated when being driven by a driving mechanism (not illustrated) using the lifting-cam rotation shaft 2008 as a center. Accordingly, when the lifting cam 2007 is rotated using the lifting-cam rotation shaft 2008 as the center, the pressure member 2006 may move up and down so as to move close to or separate from the wiping member 2001.

Figure 3:
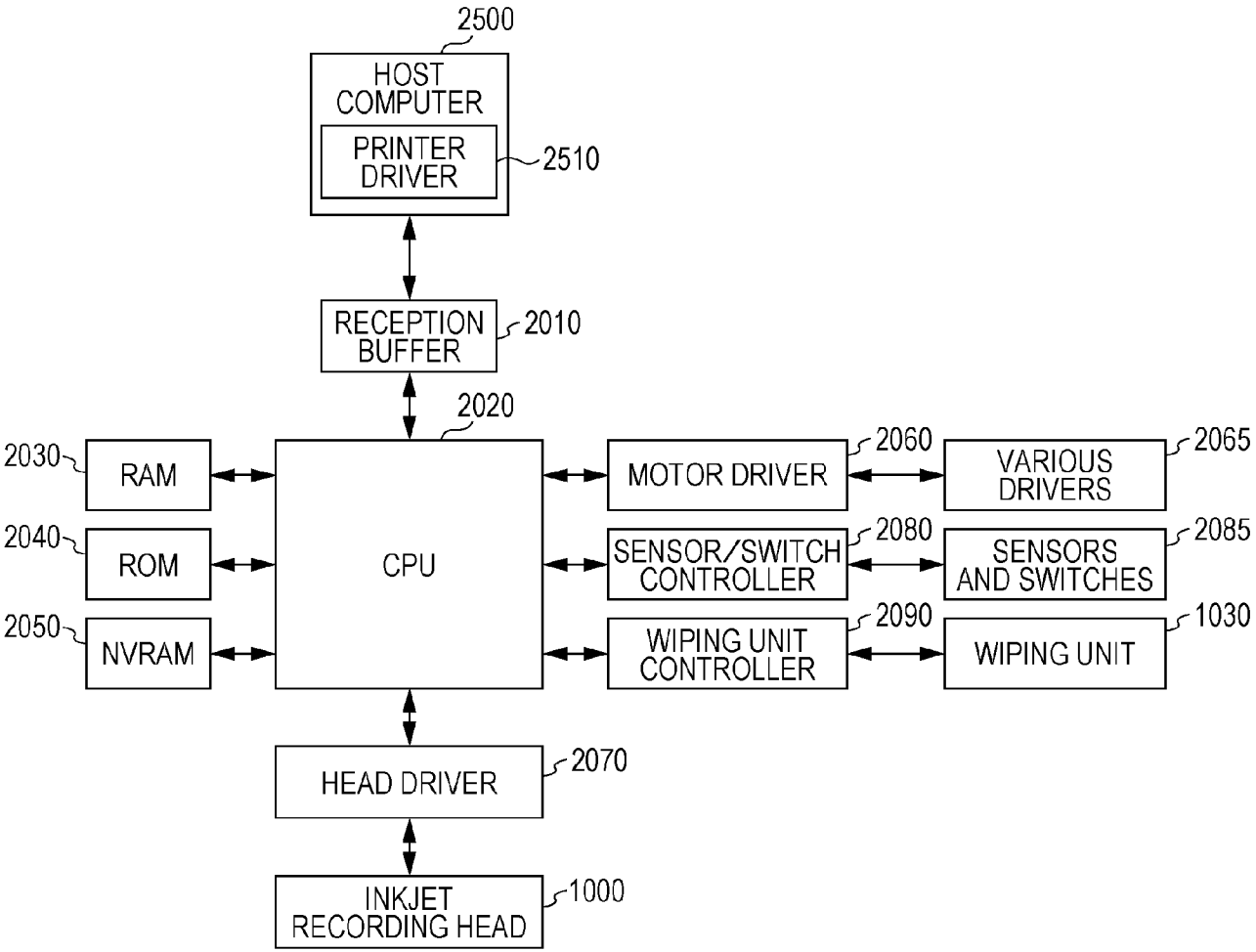
FIG. 3 is a block diagram illustrating a controller included in the inkjet recording apparatus of FIG. 1.

A controller which controls operation of the inkjet recording apparatus will be described with reference to FIG. 3. The controller of the inkjet recording apparatus is connected to a host computer 2500 through a USB interface or the like. The controller of the inkjet apparatus includes a reception buffer 2010 which receives data from a printer driver 2510 which is software stored in the host computer 2500. The reception buffer 2010 and storage units (a RAM 2030, a ROM 2040, and an NVRAM 2050) are connected to a central processing unit (CPU) 2020. A head driver 2070, a motor driver 2060, a sensor/switch controller 2080, and a wiping unit controller 2090 are also connected to the CPU 2020. The RAM 2030 is a memory which temporarily stores recording data and the like received by the reception buffer 2010. The ROM 2040 is a memory which stores programs, fixed data, and the like which are used to control various operations of the inkjet recording apparatus. The NVRAM 2050 is a nonvolatile memory which stores information to be stored even after power of the inkjet recording apparatus is turned off. The motor driver 2060 drives various motors 2065 such as the carriage motor and a conveying motor. The head driver 2070 drives the recording head 1000. The sensor/switch controller 2080 controls sensors and switches 2085. The wiping unit controller 2090 drives the lifting cam 2007 of the wiping unit 1030, controls rotation of the conveying roller pair 2004, and manages a remaining amount of an unused portion of the wiping member 2001.

Next, a recording operation of the inkjet recording apparatus of this embodiment will be described. The printer driver 2510 of the host computer 2500 generates recording data from a document or image data such as a photograph to be recorded in accordance with a recording instruction issued by a user and transmits the recording data to the reception buffer 2010 of the inkjet recording apparatus. The recording data stored in the reception buffer 2010 is transferred to the RAM 2030 under control of the CPU 2020 and temporarily stored in the RAM 2030. In accordance with the recording data, the CPU 2020 activates the various motors 2065 through the motor driver 2060 using the programs, the fixed data, and the like which are stored in the ROM 2040 and the NVRAM 2050. Specifically, a recording-target medium is intermittently conveyed in a Y direction (a depth direction) on the platen 1200 by an intermittent operation of the conveying motor, and the carriage 1100 is intermittently conveyed in an X direction by an intermittent operation of the carriage motor. When the carriage 1100 moves through a position facing the recording-target medium which is stopped, the inks are ejected from the ejection ports 1001 to 1004 at an appropriate timing so as to adhere to the recording-target medium. The movement of the recording-target medium in the Y direction, the movement of the carriage 1100 in the X direction, and the ejection of the inks are alternately performed so that recording (image forming) is performed on the recording-target medium.

Figure 4A:
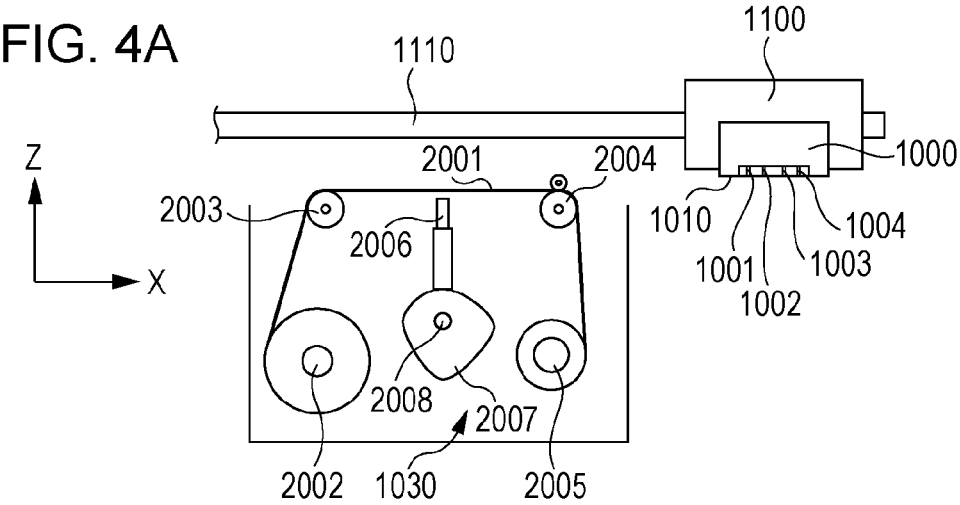
FIGS. 4A to 4F are diagrams illustrating a wiping operation of an inkjet recording method performed by the inkjet recording apparatus.
Figure 4B:
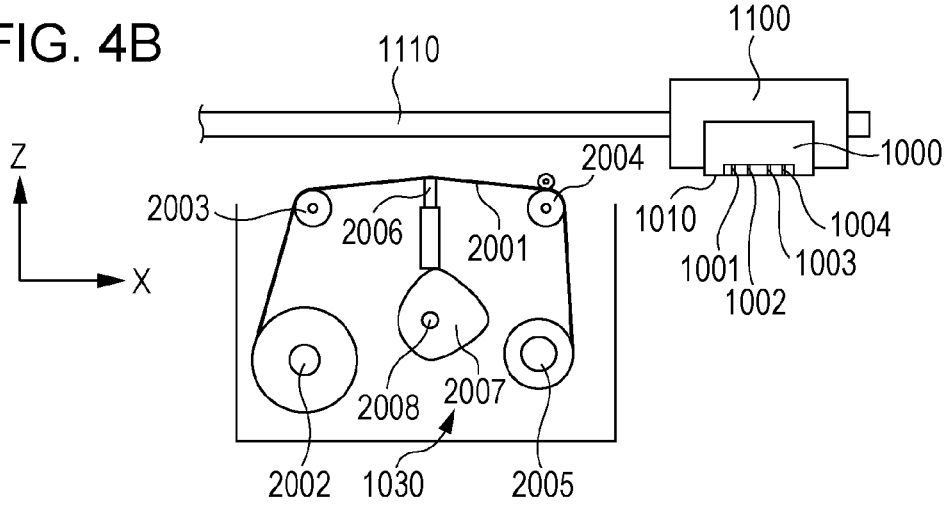
Figure 4C:
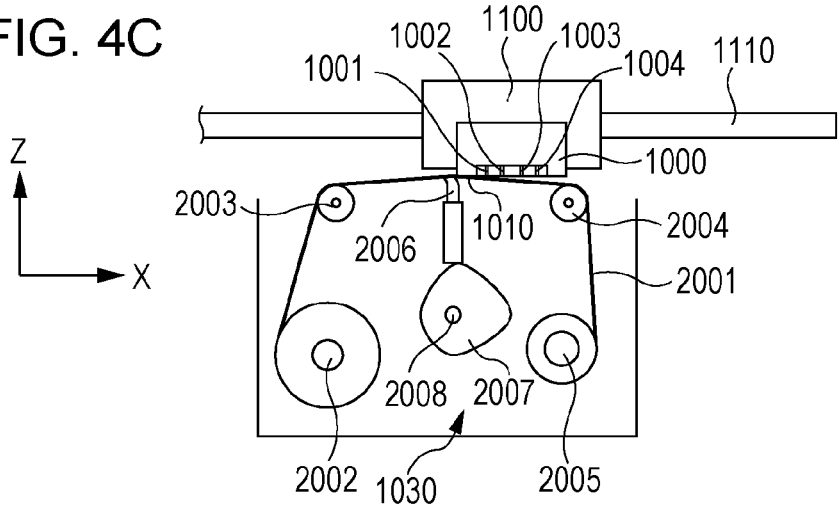
Figure 4D:
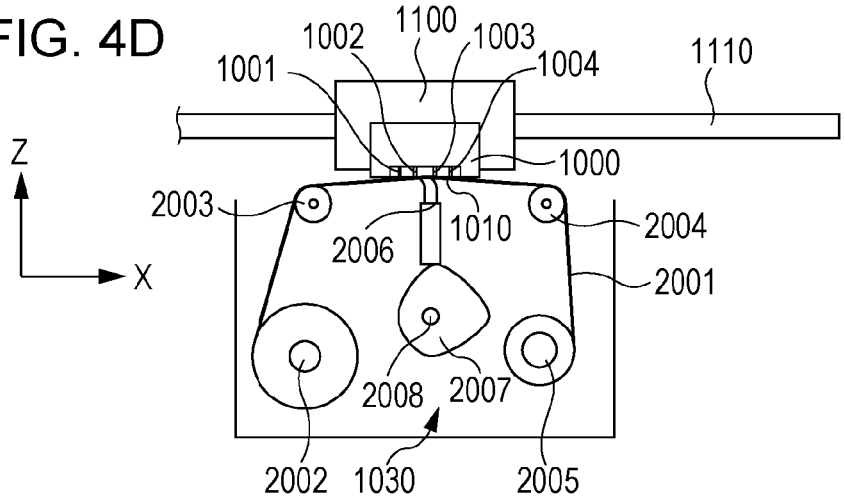

A case where the wiping operation is performed on the face surface 1010 of the recording head 1000 during the recording operation will be described with reference to FIGS. 4A to 5. First, the CPU 2020 issues an instruction for starting the wiping operation to the wiping unit controller 2090 in accordance with a counting value representing the number of times ejection of inks is performed, time measurement performed by a timer, or measurement of recording duty (in step S101). Then the CPU 2020 activates the wiping unit controller 2090 so that the lifting cam 2007 of the wiping unit 1030 is driven to be rotated. The pressure member 2006 moves the wiping member 2001 from a retracting position (refer to FIG. 4A) in which the wiping member 2001 does not come into contact with the face surface 1010 of the recording head 1000 to an advanced position (refer to FIG. 4B) in which the wiping member 2001 may come into contact with the face surface 1010 (in step S102). In this state, the CPU 2020 activates the carriage motor using the motor driver 2060 so that the carriage 1100 moves from a waiting position illustrated in FIGS. 4A and 4B to a position facing the platen 1200 (refer to FIG. 1) (in step S103). When the recording head 1000 at least arrives at a position facing the wiping unit 1030, the wiping member 2001 which is pushed up by the pressure member 2006 abuts on the face surface 1010 so as to perform the wiping operation as illustrated in FIGS. 4C and 4D. Specifically, the face surface 1010 is wiped by the clean wiping member 2001 so that mist and fine dust which have adhered to the face surface 1010 are removed.

Figure 4E:
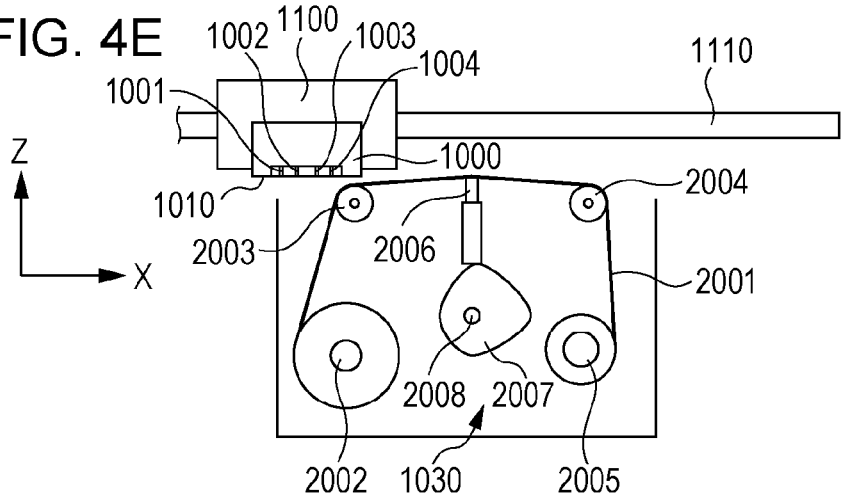
Figure 4F:
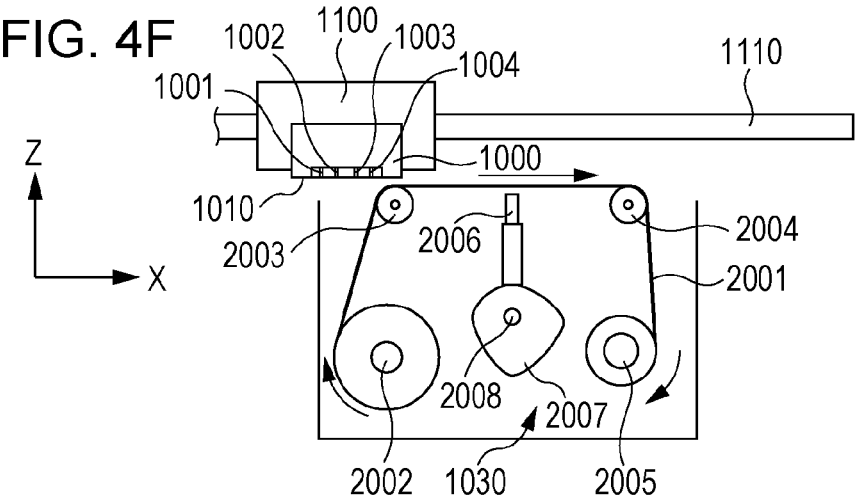
Figure 5:
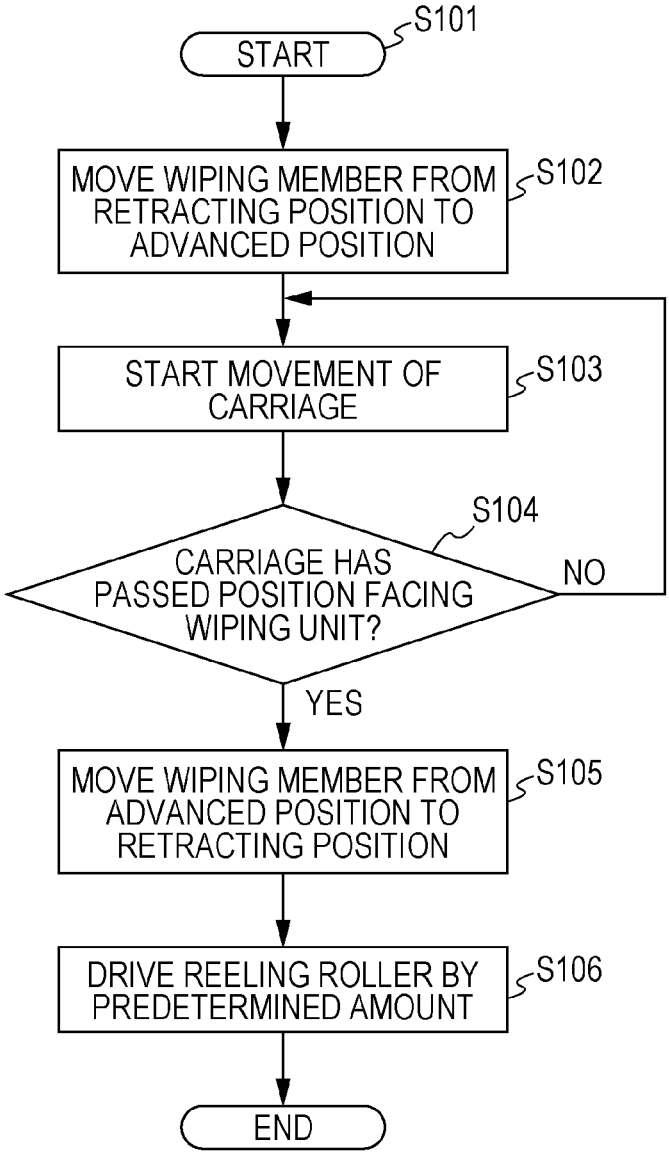
FIG. 5 is a flowchart illustrating the wiping operation of the inkjet recording apparatus.

When the carriage 1100 passes over the position facing the wiping unit 1030 (in step S104) as illustrated in FIG. 4E, the pressure member 2006 moves the wiping member 2001 from the advanced position (second position) to the retracting position (first position) as illustrated in FIG. 4F (in step S105). Thereafter, the reeling roller 2005 is driven to be rotated at a constant speed so that the wiping member 2001 is fed from the supply roller 2002 to the reeling roller 2005 by a predetermined amount (in step S106). By this, a portion of the wiping member 2001 which has been used for the wiping operation moves from the position to be contact with the pressure member 2006, and an unused portion arrives at the position to be contact with the pressure member 2006. By this, the portion used by the wiping operation of the wiping member 2001 is successively reeled by the reeling roller 2005 and an unused portion is successively drawn from the supply roller 2002. A general encoder and a reading sensor (not illustrated) are disposed on the rotation shaft of the conveying roller pair 2004, and the number of times the rotation shaft is rotated is managed by the wiping unit controller 2090 at all times. Therefore, a conveying amount of the wiping member 2001 may be controlled when the wiping unit controller 2090 controls the number of times the conveying roller pair 2004 is rotated.

When the driving of the conveying roller pair 2004 is stopped and the carriage 1100 moves from the position facing the platen 1200 after the carriage 1100 moves in the X direction and the ink ejection is performed, for example, the state illustrated in FIG. 4A is obtained again and the next wiping operation is enabled. When the operations in step S101 to step S106 are repeatedly performed as described above, the operation of wiping the face surface 1010 may be performed until the wiping member 2001 which is wound on the supply roller 2002 in advance runs out.

The operation of wiping the face surface 1010 may be performed without deteriorating throughput of the recording operation since the operation is performed during the recording operation making use of the scanning of the carriage 1100. Even when mist generated in the recording operation adheres to the face surface 1010, the mist may be immediately removed. Note that the wiping operation may be performed when the waiting state is entered after the recording operation is performed or when the inkjet recording apparatus is not powered. Furthermore, the series of operations illustrated in FIGS. 4A to 4F may be performed every time reciprocation scanning is performed by the carriage 1100 the predetermined number of times. For example, when an image is formed using a small amount of ink, an amount of generated mist is small. Therefore, if the wiping operation is performed only once every time the reciprocation scanning is performed the predetermined number of times, high ink ejection performance of the recording head 1000 may be maintained.

Note that, although the case where the wiping operation is performed while the scanning is performed by the carriage 1100 in a backward direction toward the platen 1200 (−X direction) is described in FIGS. 4A to 4F, the wiping operation may be performed while the scanning is performed by the carriage 1100 in a forward direction (+X direction). Alternatively, the wiping operation may be performed in the scanning in both of the backward direction and the forward direction.

In this embodiment, since the number of times the conveying roller pair 2004 is rotated is managed by the wiping unit controller 2090 at all times, the wiping unit controller 2090 may calculate a total amount of the conveyed wiping member 2001 using the total number of times the conveying roller pair 2004 is rotated. By this, an integrated use amount of the wiping member 2001 is obtained, and in accordance with the integrated use amount, an amount of an unused portion of the wiping member 2001, that is, a remaining amount, may be obtained by the wiping unit controller 2090 through calculation.

Figure 6:
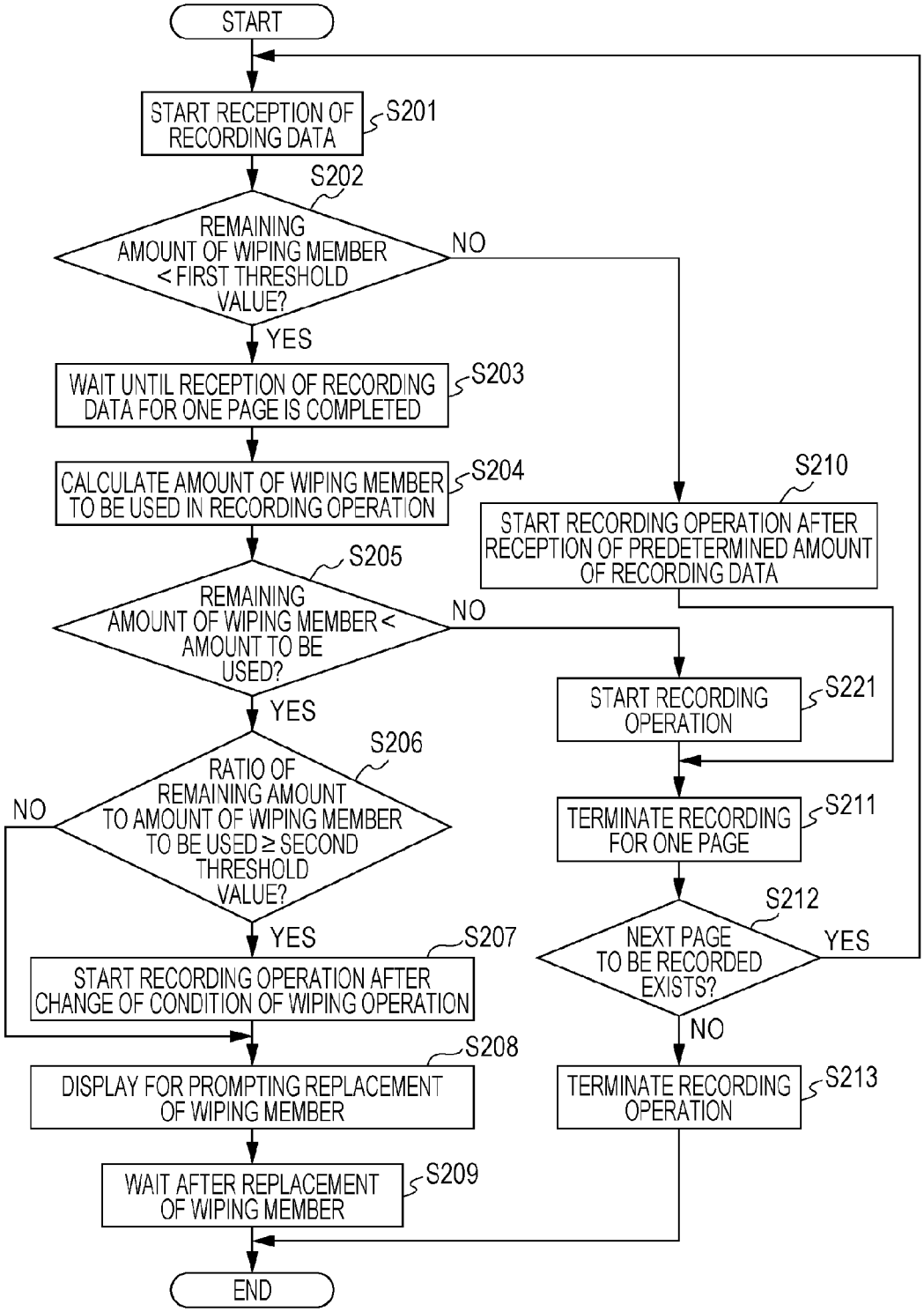
FIG. 6 is a flowchart illustrating control of the wiping unit included in the inkjet recording apparatus.

A process performed when a remaining amount of an unused portion of the wiping member 2001 becomes small according to the present invention will be described in detail with reference to a flowchart illustrated in FIG. 6.

First, when the host computer 2500 issues a recording instruction to the inkjet recording apparatus which is in a waiting state, the reception buffer 2010 starts reception of recording data (in step S201). Thereafter, it is determined whether a remaining amount of an unused portion of the wiping member 2001 obtained as described above is smaller than a predetermined first threshold value (in step S202). The first threshold value is larger than an estimated total use amount of the wiping member 2001 to be used when it is assumed that the wiping operation is performed every time the reciprocation scanning is performed by the carriage 1100 when an image having the maximum size in one printing job is formed in the recording device. Specifically, when a remaining amount of an unused portion of the wiping member 2001 is equal to or larger than the first threshold value, the wiping member 2001 does not run out during a recording operation for one printing job. When it is determined that a remaining amount of the wiping member 2001 is equal to or larger than the first threshold value in step S202, the reception buffer 2010 starts a recording operation as soon as the reception buffer 2010 receives a predetermined amount of recording data (in step S210). The predetermined amount of recording data is not an amount of the entire recording data for one printing job (recording data for one page) but an amount of recording data smaller than the amount of the entire recording data. Specifically, the recording operation (in step S210) is performed in parallel to the operation of receiving the recording data continuously performed. After the entire recording operation for one printing job (recording for one page) is terminated (in step S211), it is determined whether a printing job to be performed next (a next page to be recorded) exists (in step S212). When the determination is affirmative, reception of recording data is started again (in step S201), and it is determined whether a remaining amount of an unused portion of the wiping member 2001 is smaller than the first threshold value (in step S202). When the remaining amount of the unused portion of the wiping member 2001 is equal to or larger than the first threshold value, the recording operation (in step S210 and step S211) and the determination as to whether a next page exists (in step S212) are performed. As described above, as long as a remaining amount of an unused portion of the wiping member 2001 is equal to or larger than the first threshold value, the operations in step S201, step S202, and step S210 to step S212 are repeatedly performed. After the recording operation of all pages is terminated (that is, when a printing job to be executed next does not exist), the recording operation is terminated (in step S213) and a waiting state is entered again.

When a remaining amount of an unused portion of the wiping member 2001 is smaller than the first threshold value in step S202, the unused portion of the wiping member 2001 may run out during the recording operation for one page. When a remaining amount of an unused portion of the wiping member 2001 is smaller than the first threshold value, the recording operation is not started and a waiting state is entered until reception of the recording data for one page (for one printing job) is completed even after the reception buffer 2010 receives a predetermined amount of recording data (in step S203). Then, information representing that a remaining amount of an unused portion of the wiping member 2001 is small is displayed for the user so that the user prepares a spare wiping member 2001. After the reception of the recording data for one page is completed, an amount of the wiping member 2001 to be used in a recording operation to be performed in accordance with the recording data (an estimated use amount) is calculated (in step S204). In this embodiment, a use amount (a conveying amount) of the wiping member 2001 per one wiping operation and a timing when the wiping operation is performed (the number of times reciprocation scanning is repeatedly performed by the carriage 1100 before the wiping operation is performed) are determined in advance. Accordingly, an amount of the wiping member 2001 to be used may be obtained in advance using the number of times the wiping operation is performed for each recording data, and the amount serves as a reference value.

The remaining amount of the unused portion of the wiping member 2001 and the amount of the wiping member 2001 to be used in a recording operation for one page (reference value) are compared with each other (in step S205). When the remaining amount of the unused portion of the wiping member 2001 is equal to or larger than the reference value, a recording operation is started (in step S221). When all the recording for one page is terminated (in step S211), it is determined whether the next page exists (in step S212). When the next page exists, the operations in step S201 to step S205, step S221, step S211, and step S212 are performed again (as long as a remaining amount of an unused portion of the wiping member 2001 is equal to or larger than the reference value). By this, the recording operation is performed on all pages, and after the recording operation is terminated (in step S213), a waiting state is entered again. Note that, in the repeat of the steps, since it is apparent that it is determined that a remaining amount of an unused portion of the wiping member 2001 is smaller than the first threshold value in step S202, the operation in step S202 may be omitted.

In the process described above, when a remaining amount of an unused portion of the wiping member 2001 is smaller than an amount of the wiping member 2001 to be used for the recording operation for one page (reference value) (in step S205), the remaining amount of the unused portion of the wiping member 2001 is compared with a second threshold value (in step S206). The second threshold value will now be described. In this embodiment, a use amount of the wiping member 2001 for one wiping operation and the number of times the wiping operation is performed in the recording operation for one page are set in advance such that the use amount and the number of times the wiping operation is performed are changeable to such an extent that image quality is not considerably deteriorated. A ratio of an amount of the wiping member 2001 to be used in a case where a use amount of the wiping member 2001 per one wiping operation and the number of times the wiping operation is performed are changed to an amount of the wiping member 2001 to be used in a normal condition before the change is made (the reference value in step S204 and step S205) is set as the second threshold value. This setting will now be described.

In general, a use amount (a conveying amount) of the wiping member 2001 per one wiping operation and the number of times the wiping operation is performed during a recording operation for one page are determined taking balance of cleaning effect of the face surface 1010, durability of the recording head 1000, and a use amount of the wiping member 2001 into consideration. Specifically, if the durability of the recording head 1000 is sacrificed to some extent, a use amount of the wiping member 2001 may be reduced. For example, it is assumed that a use amount (a conveying amount) of the wiping member 2001 per one wiping operation is 3 mm and the wiping operation is performed once every three reciprocation scanning operations of the carriage 1100 under a normal wiping condition. In this case, change is made such that the use amount (the conveying amount) of the wiping member 2001 per one wiping operation is reduced to 2.5 mm and the wiping operation is performed once every four reciprocation scanning operations of the carriage 1100. A ratio of an amount of the wiping member 2001 to be used after the change is made to an amount of the wiping member 2001 to be used in the normal condition before the change is made is 62.5%. With this degree of change of the condition, a recording operation may be performed on several pages without drastically deteriorating the ink ejection performance of the recording head 1000. Therefore, in this embodiment, the second threshold value is set to 62.5%. Note that, although the ink ejection performance of the recording head 1000 is not immediately deteriorated due to the change of the condition, the durability of the recording head 1000 is deteriorated in the long run. Accordingly, such condition change is performed as a special treatment only when a remaining amount of an unused portion of the wiping member 2001 becomes small.

When the ratio of a remaining amount of an unused portion of the wiping member 2001 to an amount of the wiping member 2001 to be used in a normal condition is equal to or larger than the second threshold value in step S206, a condition of the wiping operation is changed so that almost the entire wiping member 2001 is used when the recording operation for one page is terminated. Then the recording operation is started under the changed condition (in step S207). After the recording operation for one page is terminated, information representing that the wiping member 2001 has run out is displayed for the user so as to prompt the user to replace the wiping member 2001 by a new one (in step S208). When the replacement performed by the user is completed, the inkjet recording apparatus enters a waiting state again (in step S209).

On the other hand, when it is determined that a remaining amount of an unused portion of the wiping member 2001 to an amount of the wiping member 2001 to be used in the normal state is smaller than the second threshold value in step S206, change of the wiping condition is not performed since image quality is deteriorated. Accordingly, a recording operation is not started and information representing that the wiping member 2001 has run out is displayed for the user so as to prompt the user to replace the wiping member 2001 by a new one (in step S208). After the replacement performed by the user is terminated, the inkjet recording apparatus enters a waiting state again (in step S209).

As described above, in this embodiment, when a remaining amount of an unused portion of the wiping member 2001 becomes small, a condition of the wiping operation (for example, a use amount of the wiping member 2001 per one wiping operation and frequency of the wiping operation) is changed to such an extent that image quality is not considerably deteriorated. However, when a remaining amount of an unused portion of the wiping member 2001 is too small, it is not possible to suppress deterioration of image quality, and accordingly, a recording operation is stopped. In ether case, even when a remaining amount of an unused portion of the wiping member 2001 becomes small, a problem in which the wiping member 2001 runs out during a recording operation does not arise. Furthermore, since an unused portion of the wiping member 2001 is used as much as possible by changing a condition of the wiping operation, an amount of discarding of the unused portion of the wiping member 2001 may be suppressed when compared with general methods. Accordingly, cost may be suppressed and resource may be efficiently utilized.

Note that, when the wiping condition is changed as described above, it is highly likely that the face surface 1010 of the recording head 1000 becomes dirtier at a time when a recording operation is terminated than a case where the wiping operation is performed under the normal condition. Therefore, in order to maintain the high ink ejection performance of the recording head 1000, the suction recovery operation may be performed by the capping mechanism before the next recording operation is started so as to refresh the face surface 1010. Alternatively, in order to recover the high ink ejection performance of the recording head 1000, the suction recovery operation may be performed immediately after a recording operation is terminated. It is apparent that the suction recovery operation may be performed before and after a recording operation. Furthermore, it is efficient that, when the wiping condition is changed, the number of times a preliminary ejection operation is performed after a wiping operation is larger than the number of times the preliminary ejection operation is performed after a normal wiping operation so that fixing of ink is prevented. Furthermore, when the wiping condition is changed, a suction recovery operation attaining a suction recovery effect larger than general recovery operations may be performed so that the face surface 1010 which is dirtier is refreshed, and the number of times suction is performed in the suction recovery operation may be increased when compared with the general recovery operations. Alternatively, immediately after the wiping member 2001 is replaced by a new one, the wiping operation may be performed by the new one. Furthermore, although not illustrated, an optical ejection state detection mechanism or an electric ejection state detection mechanism may be provided so as to detect an ejection state after a recording operation under a changed wiping condition. In this case, when an error is detected in the ejection state, the suction recovery operation and the wiping operation may be specially performed a number of times. It is apparent that the processes described above performed to maintain and recover the high ink ejection performance may be appropriately combined with one another.

According to this embodiment, when a remaining amount of an unused portion of the wiping member 2001 of a sheet shape is large, reception of recording data and a recording operation may be performed in parallel, and accordingly, efficient recording may be performed while deterioration of throughput is suppressed. Furthermore, when a remaining amount of an unused portion of the wiping member 2001 of a sheet shape is small, a recording operation is not started until calculation of an amount of the wiping member 2001 to be used in the recording operation is completed. Accordingly, the wiping member 2001 is prevented from running out during the recording operation in advance. In addition, when a remaining amount of an unused portion of the wiping member 2001 is slightly short of an amount to be used, a wiping condition (frequency of a wiping operation in a recording operation and a use amount of the wiping member 2001 per one wiping operation) is changed to such an extent that image quality is not deteriorated and a recording operation is executed. Accordingly, the wiping member 2001 is utilized as much as possible while the wiping member 2001 is prevented from running out during a recording operation. Only when a remaining amount of an unused portion of the wiping member 2001 is too small and change of a wiping condition to such an extent that image quality is not deteriorated is not possible, replacement of the wiping member 2001 is prompted without starting a recording operation. By this, a discarding amount of an unused portion of the wiping member 2001 is suppressed, cost is suppressed, and waste of resources is suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-076641, filed Mar. 29, 2012 and No. 2013-045528 filed Mar. 7, 2013, which are hereby incorporated by reference herein in its entirety.

What is claimed is:

1. An inkjet recording apparatus comprising:

a recording head configured to include an ejection surface having a plurality of ejection ports which eject ink;

a carriage configured to include the recording head and perform reciprocation scanning;

a wiping unit configured to include a wiping member which wipes the ejection surface and a reeling unit which reel the wiping member;

an obtaining unit configured to obtain a remaining amount of the wiping member;

an estimation unit configured to estimate a use amount of the wiping member in accordance with recording data; and a controller configured to control the wiping unit in accordance with the remaining amount and the use amount.

2. The inkjet recording apparatus according to claim 1, wherein the controller performs control such that a reeling amount in a first case where the remaining amount is smaller than the estimated use amount becomes smaller than a reeling amount in a second case where the remaining amount is equal to or larger than the estimated use amount.

3. The inkjet recording apparatus according to claim 2, wherein, when the reeling amount in the first case is employed, an image is not deteriorated.

4. The inkjet recording apparatus according to claim 2, wherein the controller prompts a user to replace the wiping member after a recording operation for one page is terminated in the first case.

5. The inkjet recording apparatus according to claim 1, wherein the controller performs control such that the number of times a wiping operation is performed during a recording operation for one page in a first case where the remaining amount is smaller than the estimated use amount becomes smaller than the number of times a wiping operation is performed during a recording operation for one page in a second case where the remaining amount is equal to or larger than the estimated use amount.

6. The inkjet recording apparatus according to claim 1, wherein the controller prompts a user to replace the wiping member when it is determined that it is not possible to perform the control without deteriorating image quality in accordance with the remaining amount and the estimated use amount.

7. The inkjet recording apparatus according to claim 1, wherein the estimation unit estimates the use amount in accordance with recording data for one page.

8. The inkjet recording apparatus according to claim 1, wherein the wiping member performs a wiping operation on the ejection surface while the carriage performs scanning on the wiping member.

9. The inkjet recording apparatus according to claim 1, wherein the wiping unit further includes a pressure member which moves the wiping member to a position to be contact with the ejection surface, and the wiping member is moved to the position by the pressure member before the wiping unit performs a wiping operation.

10. The inkjet recording apparatus according to claim 1, wherein the wiping member is impregnated with liquid.

11. A method for controlling an inkjet recording apparatus which includes a recording head including an ejection surface having a plurality of ejection ports which eject ink and a wiping unit including a wiping member and a reeling unit which reels the wiping member, the method comprising:

obtaining a remaining amount of the wiping member;

estimating a use amount of the wiping member in accordance with recording data; and controlling the wiping unit in accordance with the remaining amount and the estimated use amount.

12. The method for controlling an inkjet recording apparatus according to claim 11, further comprising:

wiping the ejection surface using the wiping member of the wiping unit; and reeling the wiping unit using the reeling unit after the wiping.

13. The method for controlling an inkjet recording apparatus according to claim 11, wherein, in the controlling, control is performed such that a reeling amount per one reeling operation in a first case where the remaining amount is smaller than the use amount becomes smaller than a reeling amount per one reeling operation in a second case where the remaining amount is equal to or larger than the use amount.

14. The method for controlling an inkjet recording apparatus according to claim 11, wherein, in the controlling, control is performed such that the number of times a wiping operation is performed during a recording operation for one page in a first case where the remaining amount is smaller than the use amount becomes smaller than the number of times a wiping operation is performed during a recording operation for one page in a second case where the remaining amount is equal to or larger than the use amount.

* * * * *